US006014978A

United States Patent [19]

Yuhara

[11] Patent Number: 6,014,978

[45] Date of Patent: Jan. 18, 2000

[54] COMPACT COSMETIC CASE CAPABLE OF DISPLAYING THE INSIDE THEREOF

[75] Inventor: Yukitomo Yuhara, Tokyo, Japan

[73] Assignee: Yoshida Kogyo Co., Ltd., Tokyo, Japan

[21] Appl. No.: 09/321,613

[22] Filed: May 28, 1999

[51] Int. Cl.[7] ..... A45D 33/00

[52] U.S. Cl. ..... 132/293; 132/315; 206/581; 206/823; 220/817

[58] Field of Search ..... 132/293, 294, 132/295, 296, 298, 300, 301, 315, 316; 206/45.2, 45.23, 581, 823, 235; 220/817, 848, 818

[56] References Cited

U.S. PATENT DOCUMENTS

| | | | |
|---|---|---|---|
| 4,195,650 | 4/1980 | Ullmann et al. | 132/315 |
| 4,684,017 | 8/1987 | Watanabe et al. | 206/235 |
| 4,840,288 | 6/1989 | Lunderman et al. | 220/817 |
| 5,078,159 | 1/1992 | Yuhara | 132/293 |
| 5,325,984 | 7/1994 | Ady et al. | 220/817 |
| 5,568,820 | 10/1996 | Dirksing | 132/293 |

*Primary Examiner*—Todd E. Manahan

[57] ABSTRACT

This invention is relates to a cosmetic case capable of displaying the inside of the case, comprising a housing for containing a cosmetic material, the housing having an opening for exposing the surface of the cosmetic material, a lid for closing the opening formed at the housing and a hinge member attached to each edge of the housing and the lid to rotatably connect the housing and the lid with each other so that respective outer surfaces of the housing and the lid come to face closely to each other. The hinge member comprises a pair of shafts members and a pair of support members, each support member arranged on each end of the pair of the shaft members. Each of the housing and the lid has a coupling portion having a fitting groove for fitting one of the shaft members to hide the shaft members and to expose the support members on opposite sides of the coupling portion.

3 Claims, 10 Drawing Sheets

COMPACT COSMETIC CASE CAPABLE OF DISPLAYING THE INSIDE THEREOF

BACKGROUND OF THE INVENTION

1. Field of the Invention

This invention relates to a compact cosmetic case coupling a lid and a housing with each other through a hinge member and, more particularly, to a compact cosmetic case capable of displaying the inside of the case by exposing the interior of the housing where each back of the lid and the housing faces closely to one another.

2. Description of Related Art

Cosmetic products including compact cosmetic cases are frequently sold these days in a way not for face to face sales in which a customer faces with a shop clerk having knowledge for products but for sales for ordinary goods in which a customer freely selects some among products displayed in the shop. Because, with the cosmetic products sold by such a sale method, the contents of the products are necessarily known to the customers accurately while the products are displayed, it is required, particularly for cosmetic products such as eye shadows or the like in which information about color and brightness must be accurately shown to customers, to be displayed in a way that the inside of the compact cosmetic case is identified when seen from the outside.

A compact cosmetic case had been proposed in, e.g., Japanese Utility Model (Petty Patent) Publication Showa No. 63-40,164, in which a lid of the compact cosmetic case is rotated almost 360 degrees when displayed at a store to show outside the color of the cosmetic material contained in the housing. The compact cosmetic case has a hinge member in a block shape fitted in a connection recess formed at a center of each edge of the lid and the housing, and shafts are inserted respectively between the lid and the hinge member and between the housing and the hinge member.

With such a structure, the conventional compact cosmetic case can be displayed as to show the inside of the housing by rotating almost 360 degrees the lid with respect to the housing.

The conventional compact cosmetic case described above generally has a structure that the hinge member is fitted in the connection recess between the lid and the housing and engaged with spring pins, but because the operator has to insert the spring pins in maintaining the hinge member at a prescribed position when the case is assembled, and because assembling the case requires a special positioning jig, the case cannot be assembled easily.

To the contrary, a conceivable method is to assemble directly the lid and the housing to the hinge member without using any spring pin. The compact cosmetic case thus structured, however, may disengage the hinge member on impact. Such a compact cosmetic case is generally carried as placed in a bag, so that the cosmetic material may be scattered in the bag if a small impact disengages the hinge member.

SUMMARY OF THE INVENTION

Therefore, it is an object of the invention to provide a compact cosmetic case capable of displaying the inside of the case possessing a good productivity and good impact resistance.

The foregoing object is accomplished with a compact cosmetic case capable of displaying the inside of the case, including a housing for containing a cosmetic material, the housing having an opening for exposing the surface of the cosmetic material, a lid for closing the opening formed at the housing, and a hinge member attached to each edge of the housing and the lid to rotatably connect the housing and the lid with each other so that respective outer surfaces of the housing and the lid come to face closely to each other, the hinge member having a pair of shafts members, and a pair of support members, each support member arranged on each end of the pair of the shaft members, wherein each of the housing and the lid has a coupling portion having a fitting groove for fitting one of the shaft members to hide the shaft members and to expose the support members on opposite sides of the coupling portion.

According to such a compact cosmetic case capable of displaying the inside of the case, when the compact cosmetic case is assembled, assembling work is completed only by insertion of the shaft members of the hinge member into the fitting grooves of the coupling portions of the housing and the lid, so that operators can easily assemble the compact cosmetic case without using any special positioning jig.

Since such a compact cosmetic case has a structure that the coupling portions formed at the housing and the lid are sandwiched by the support members of the hinge member, the housing and the lid are not readily disengaged from the hinge member, and the case becomes a container having good durability because the lid hardly positionally shifts from the housing even where the lid is open and closed so frequently.

With the compact cosmetic case according to the invention, the two support members of the hinge member for sandwiching the coupling portions of the housing and the lid are formed as a single part through the coupling portions, the number of parts constituting the compact cosmetic case can be reduced.

In such a compact cosmetic case, the hinge member has a flat face portion, which is placed closely on a side of the housing and hidden where the housing and the lid are in a closed state, and which serves as a bottom surface for supporting the whole case by coming to a position on the opposite side to the housing where the housing and the lid are so rotated that respective outer surfaces of the housing and the lid come to face closely to each other.

With such a compact cosmetic case, the support members located on the opposite ends of the hinge member serve as legs supporting the opposite sides of the grounding bottom of the compact cosmetic case, so that the compact cosmetic case has an effect to be displayed in a state that the compact cosmetic case is stably made upright.

In another aspect of the invention for solving the above problem, a compact cosmetic case capable of displaying the inside of the case, includes a housing for containing a cosmetic material, the housing having an opening for exposing the surface of the cosmetic material and an extended portion in which a fitting hole is formed, a lid for closing the opening formed at the housing, the lid having an extended portion in which a fitting hole is formed, and a hinge member attached to each edge of the housing and the lid to rotatably connect the housing and the lid with each other so that respective outer surfaces of the housing and the lid come to face closely to each other, the hinge member having a pair of axial members extending parallel to each other formed on the hinge member, each axial member having a diameter substantially equal to a diameter of the fitting holes, elasticity in the diameter direction, and an engagement portion made on a tip of the axial member radially larger than the diameter of the axial member.

According to such a compact cosmetic case, the case can be assembled easily only by insertion of the axial members of the hinge member into the fitting holes formed in the extended portions of the housing and the lid. Therefore, the compact cosmetic case can make the assembling work simplified and can reduce the number of parts for constituting the case, so that the compact cosmetic case advantageously has an effect to suppress the costs for the assembling work and the parts.

In the compact cosmetic case, the engagement portion is formed on a tip of the axial member to prevent the axial member from disengaging, and the tip of the axial member is engaged with the opposite side of the extended portion to prevent the hinge member from disengaging from the housing and the lid. Therefore, in the compact cosmetic case according to the invention, the hinge member would not be disengaged even where receiving impacts while the case is carried in placing in, e.g., a bag, so that the compact cosmetic case can prevent the cosmetic products from subjecting to accidents such that the cosmetic material is scattered.

BRIEF DESCRIPTION OF THE DRAWINGS

The above and other objects and features of the invention are apparent to those skilled in the art from the following preferred embodiments thereof when considered in conjunction with the accompanied drawings, in which.

DESCRIPTION OF THE PREFERRED EMBODIMENTS

First Embodiment

Figure 1:
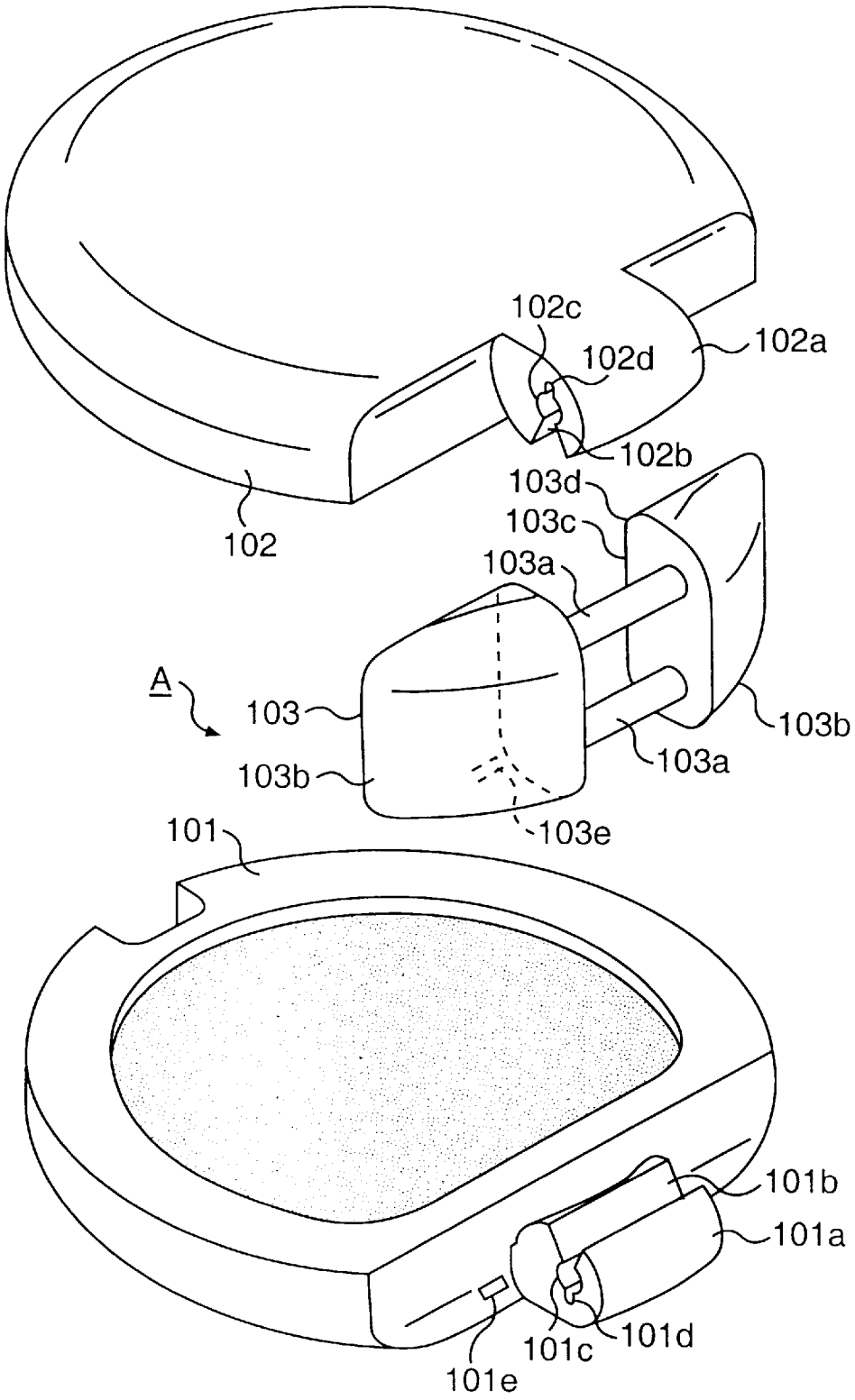
FIG. 1 is an exploded perspective view showing a compact cosmetic case according to the first embodiment.
Figure 2:
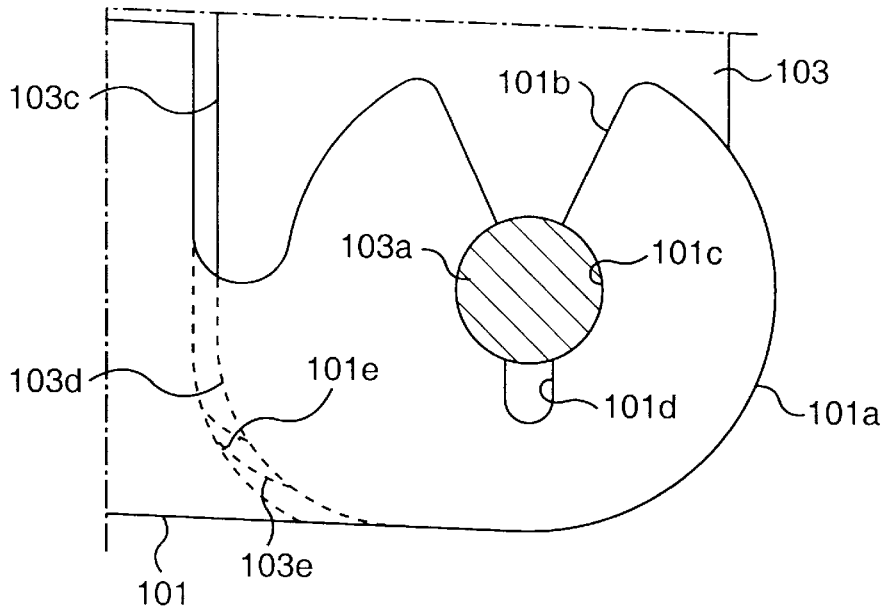
FIG. 2 is an enlarged cross section showing a hinge portion of the compact cosmetic case.
Figure 3:
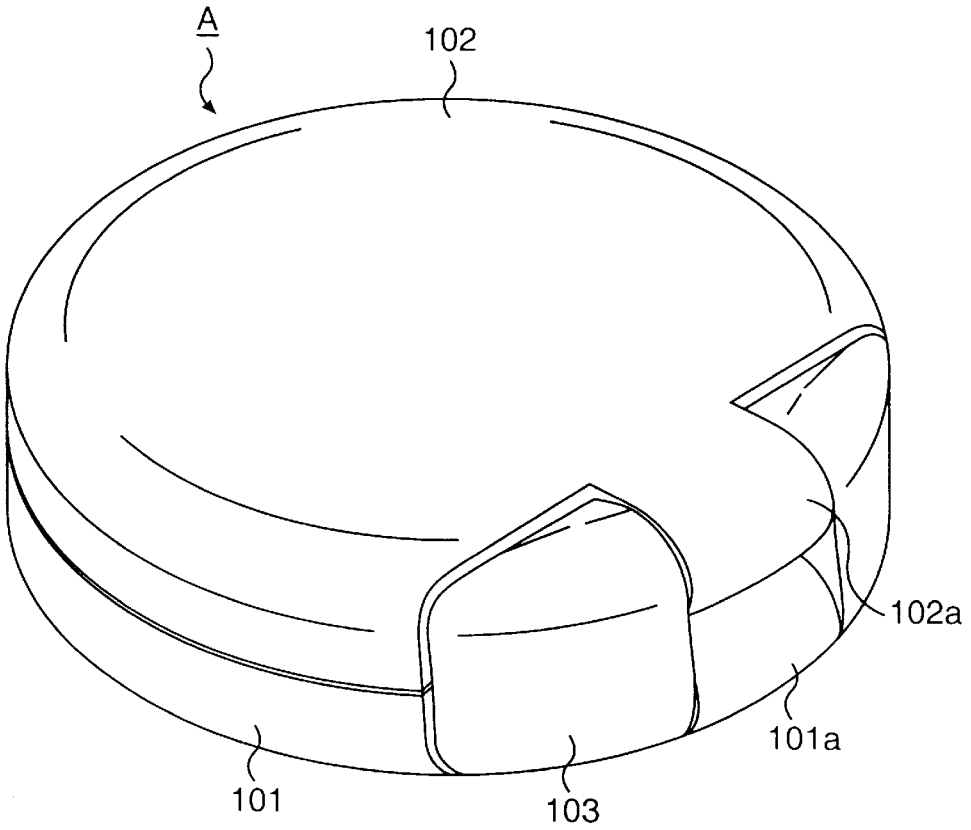
FIG. 3 is a perspective view showing the whole compact cosmetic case.
Figure 4:
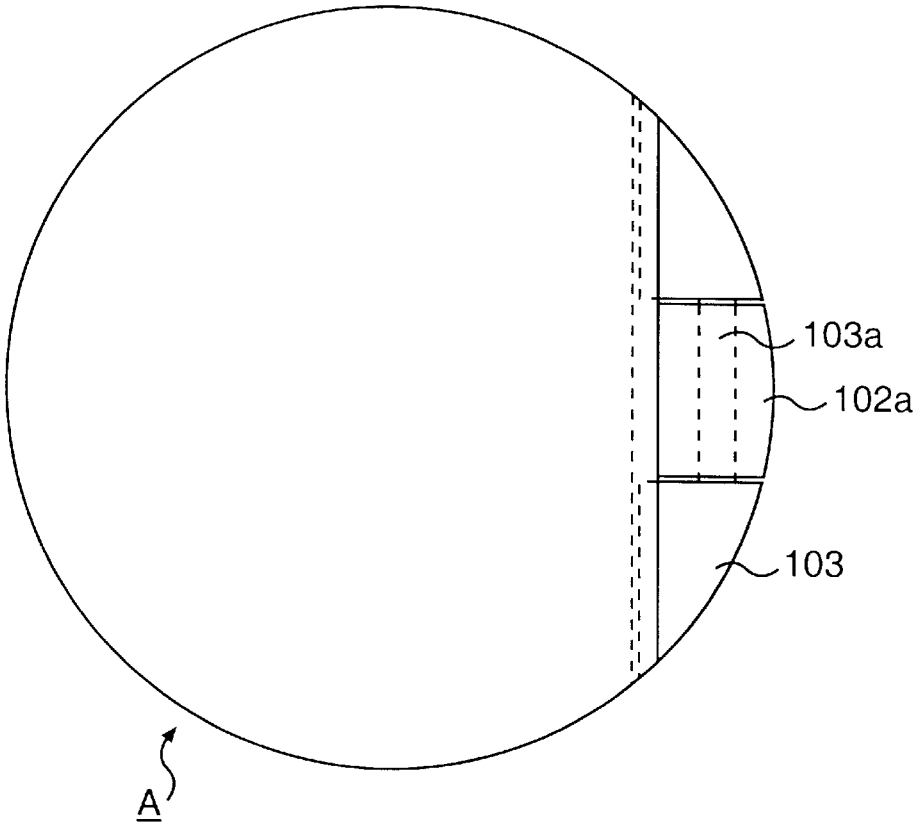
FIG. 4 is a top view showing the compact cosmetic case.
Figure 5:
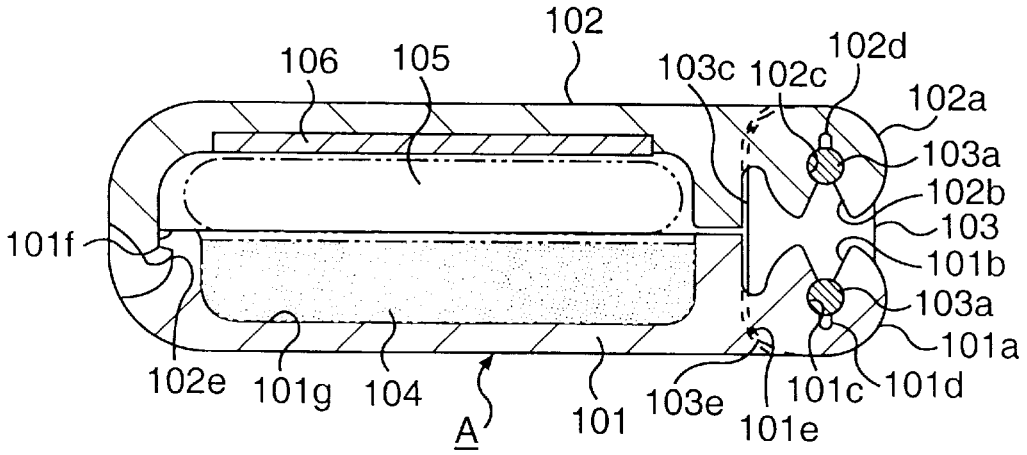
FIG. 5 is a side cross section showing the compact cosmetic case in a state that the lid is closed.

Referring to the drawings, the first embodiment of a compact cosmetic case capable of displaying the inside of the case according to the invention is described. FIG. 1 is an exploded perspective view showing a compact cosmetic case according to this embodiment; FIG. 2 is an enlarged cross section showing a hinge portion of the compact cosmetic case; FIG. 3 is a perspective view showing the whole compact cosmetic case; FIG. 4 is a top view showing the compact cosmetic case; FIG. 5 is a side cross section showing the compact cosmetic case.

The compact cosmetic case A is generally constituted of a housing 101, a lid 102, and a hinge member 103, which are made of a synthetic resin. Coupling projections 101*a*, 102*a* are formed in projecting each center of the projections from one edge of each of the housing 101 and the lid 102. Fitting grooves 101*b*, 102*b* are formed at positions facing to each other where the housing 101 and the lid 102 are in a closed state, and shaft holes 101*c*, 102*c* are formed in deep positions in the fitting grooves 101*b*, 102*b*. The shaft holes 101*c*, 102*c* are positioned respectively around the centers of the coupling projections 101*a*, 102*a*. Cutoffs 101*d*, 102*d* are provided on the opposite side of the fitting grooves 101*b*, 102*b* to ensure elasticity of the coupling projections 101*a*, 102*a*.

The hinge member 103 is constituted in a united body in having two shaft members 103*a* and support members on each of the opposite ends of the shaft members 103*a*. Those may be molded in a united body from a synthetic resin, but can be constituted by an insertion molding method in which the support members 103*b*, 103*b* on both ends are molded on the shaft members 103*a*, 103*a* after the shaft members 103*a*, 103*a* are formed of a metal.

As shown in FIG. 2, when the shaft member 103*a* is pressed into the fitting groove 101*b* of the housing 101, the tip of the coupling projection 101*a* is bent in aid of the elasticity of the housing material, and the shaft member 103*a* fits into the shaft hole 101*c* and is supported rotatively. In substantially the same way, the other shaft member 103*a* is fitted into the shaft hole 102*c* through the fitting groove 102*b* of the lid 102, so that the housing 101 and the lid 102 can be coupled rotatively. The shaft member 103*a* has a length substantially equal to the width of the coupling projections 101*a*, 102*a* of the housing 101 and the lid 102, and therefore, when those are coupled, the shaft member 103*a* is made hidden by the coupling projections 101*a*, 102*a* as shown in FIG. 3, FIG. 4, as viewed as a united body.

The support member 103*b* provided on both sides of the hinge member 103 has a flat face portion 103*c* on an one side, and the flat face portion 103*c* is located on a housing side where the housing 101 and the lid 102 are in the closed state. Accordingly, the flat face portion 103*c* is hidden where the housing 101 and the lid 102 are closed, and the flat face portion 103*c* is exposed outward when the lid 102 is rotated with about 360 degrees with respect to the housing 101 as to be inverted as described below. This structure allows the compact cosmetic case A to stand upright stably with the flat face portions 103*c*, 103*c* on both sides of the hinge member 103 as described below when displayed. Corners 103*d* on both sides of the flat face portion 103*c* are chamfered, thereby preventing the housing 101 and the lid 102 from interfering with each other when either one of the housing 101 and the lid 102 rotates.

An engagement tongue 101*f* is arranged on one side of the housing 101 opposite to the coupling projection 101*a*, and on the other hand, in corresponding to this, another engagement tongue 102*e* is arranged on one side of the lid 102 opposite to the coupling projection 102*a*. The engagement tongues 101*f*, 102*e* engage with each other as shown in FIG.

5 when the housing 101 and the lid 102 are closed and can immobilize the housing 101 and the lid 102.

As showing in FIG. 2, in the support member 103 and the housing 101, engagement projections 101*e*, 103*e* are formed at positions facing to each other where the housing 101 and the lid 102 are closed. Those engagement projections 101*e*, 103*e* limit the relative rotation upon contacting to each other, but when a rotation force of a prescribed amount or more is exerted, such a limitation is released and makes the housing 101 and the lid 102 rotate.

A containing recess 101*g* for filling a cosmetic material 104 is formed with a wide opening at a center of the housing 101, and as shown in FIG. 5, a cosmetic puff 105 can be mounted on the cosmetic material 104 when used. A mirror 106 is attached to an inner surface of the lid 102 and serves when the lid 102 is open.

Figure 6:
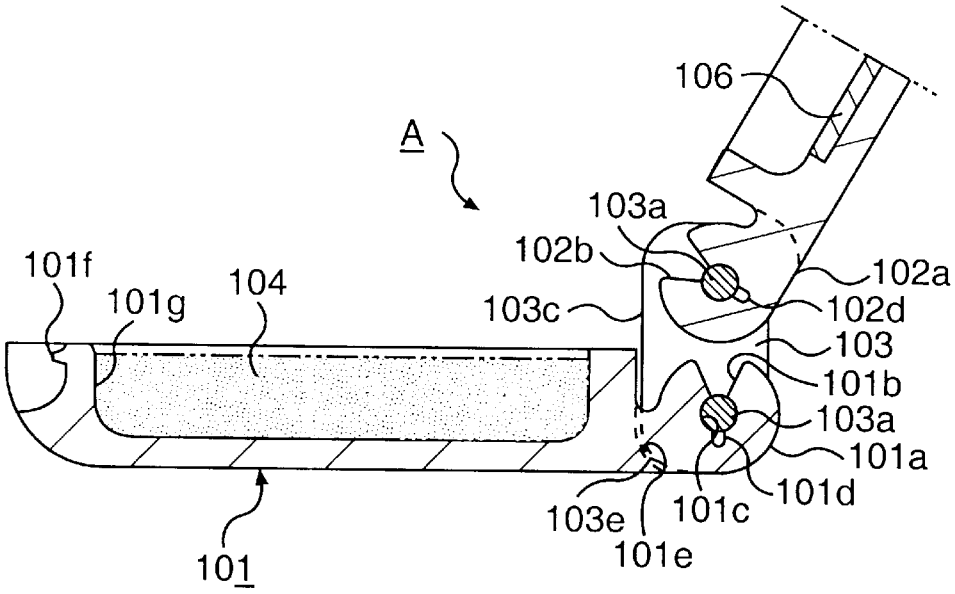
FIG. 6 is a side cross section showing the compact cosmetic case in a state that the lid is open.
Figure 7:
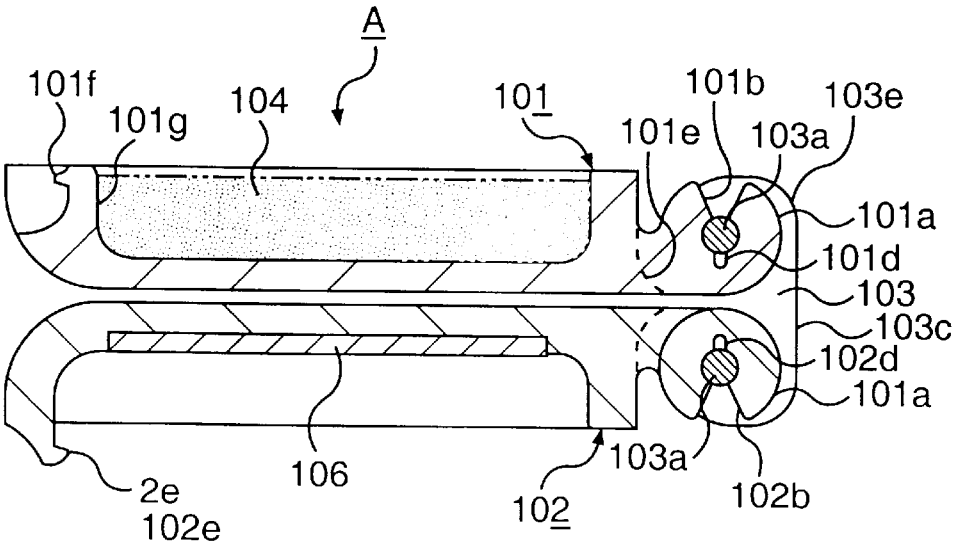
FIG. 7 is a side cross section showing the compact cosmetic case in a state that the lid is perfectly open.
Figure 8:
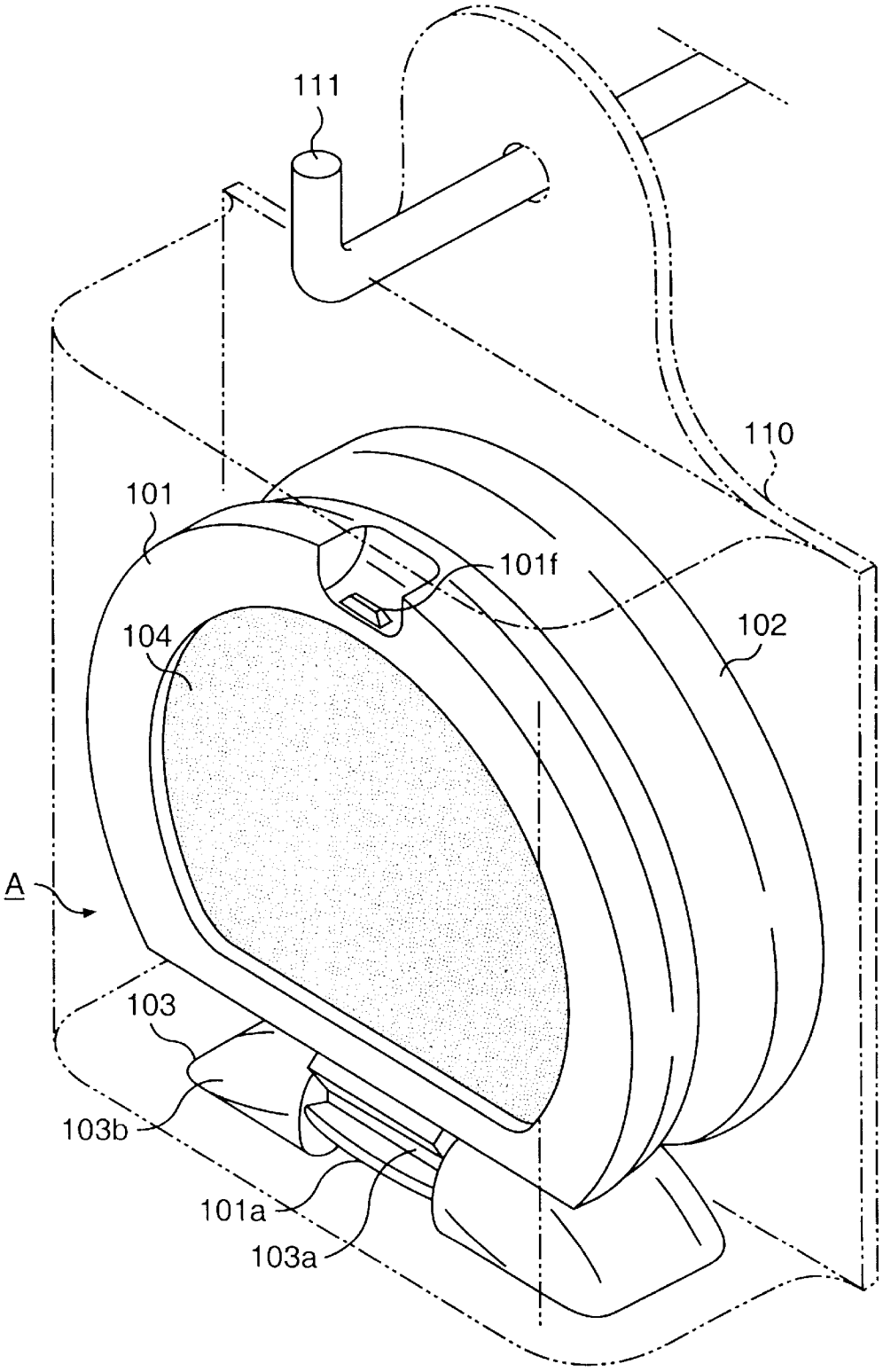
FIG. 8 is an illustration showing a display state of the compact cosmetic case.

The compact cosmetic case A according to this embodiment, as shown in FIGS. 6 to 8, operates as follows. FIG. 6 is a view showing the compact cosmetic case in a state that the lid is open; FIG. 7 is a view showing the compact cosmetic case in a state that the lid is completely opened; FIG. 8 is a perspective view showing the compact cosmetic case in a display state.

Where the compact cosmetic case A is assembled, first, the shaft member 103*a* is fitted into either of the coupling projection 101*a* of the housing 101 and the coupling projection 102*a* of the lid 102, and then the other shaft member is fitted into the other projection. By those fitting works, assembling can be completed, and as shown in FIG. 5, the housing 101 and the lid 102 can be made closed.

Where the compact cosmetic case A in the closed state is used or displayed, the engagement tongues 101*f*, 102*e* are disengaged, and the lid 102 is moved pivotally. Since the engagement projection 101*e* of the housing 101 and the engagement projection 103*e* are in contact with each other at that time, the housing 101 and the hinge member 103 do not rotate, and as shown in FIG. 6, the lid 102 and the hinge member 103 only rotate relatively. When the lid 102 is rotated, the engagement projection 101*e* and the engagement projection 103*e* are disengaged, and as shown in FIG. 7, the housing 101 and the lid 102 rotate up to respective positions that outer surfaces of the housing 101 and the lid 101 face to each other. In this state, the flat face portion 103*c* of the hinge member 103 comes to reveal on the opposite side to the housing 101 and the lid 102.

The compact cosmetic case A thus in a display state, or namely, in a state that the cosmetic material 104 is exposed, is contained in a display package 110 as shown in FIG. 8, and placed in the store as the compact cosmetic case A within the display package 110 is hung from a hook 111. The display package 110 is a package, like a so-called Brister package, whose front side is covered with at least transparent film where a product is placed on a card board paper, and customers can confirm the surface of the cosmetic material 104 where the compact cosmetic case A is contained so that the housing 101 of the compact cosmetic case A faces forward. Therefore, the compact cosmetic case can provide adequate information to the customers for product selection regarding color and brightness of the cosmetic material 104.

Although a compact cosmetic case of a conventional structure can be displayed in a state that the lid is opened with an angle of 180 degrees, the compact cosmetic case A in this embodiment can render the lid 102 rotate about 360 degrees, thereby making the lid 102 and the housing 101 displayed in an overlapped state. Therefore, the front area size when the compact cosmetic case is displayed can be made smaller, and a larger number of products can be displayed in a limited display space.

Furthermore, as described above, the flat face portion 103*c* of the hinge member 103 supports the compact cosmetic case A stably when the compact cosmetic case A is displayed as shown in FIG. 8, so that no special recess or projection inside the display package 110 is needed for supporting the compact cosmetic case A.

A customer who purchased the compact cosmetic case starts using the compact cosmetic case A by reversing the housing 101 and the lid 102 of the compact cosmetic case A with respect to the hinge member 103 as a center. The housing 101 and the hinge member 103 are immobilized by the engagement projections 101*e*, 103*e* when the compact cosmetic case A is used, and the compact cosmetic case A can be used in the same manner as an ordinary cosmetic case by rotation of the lid 102 with respect to the housing 101.

Second Embodiment

Figure 9:
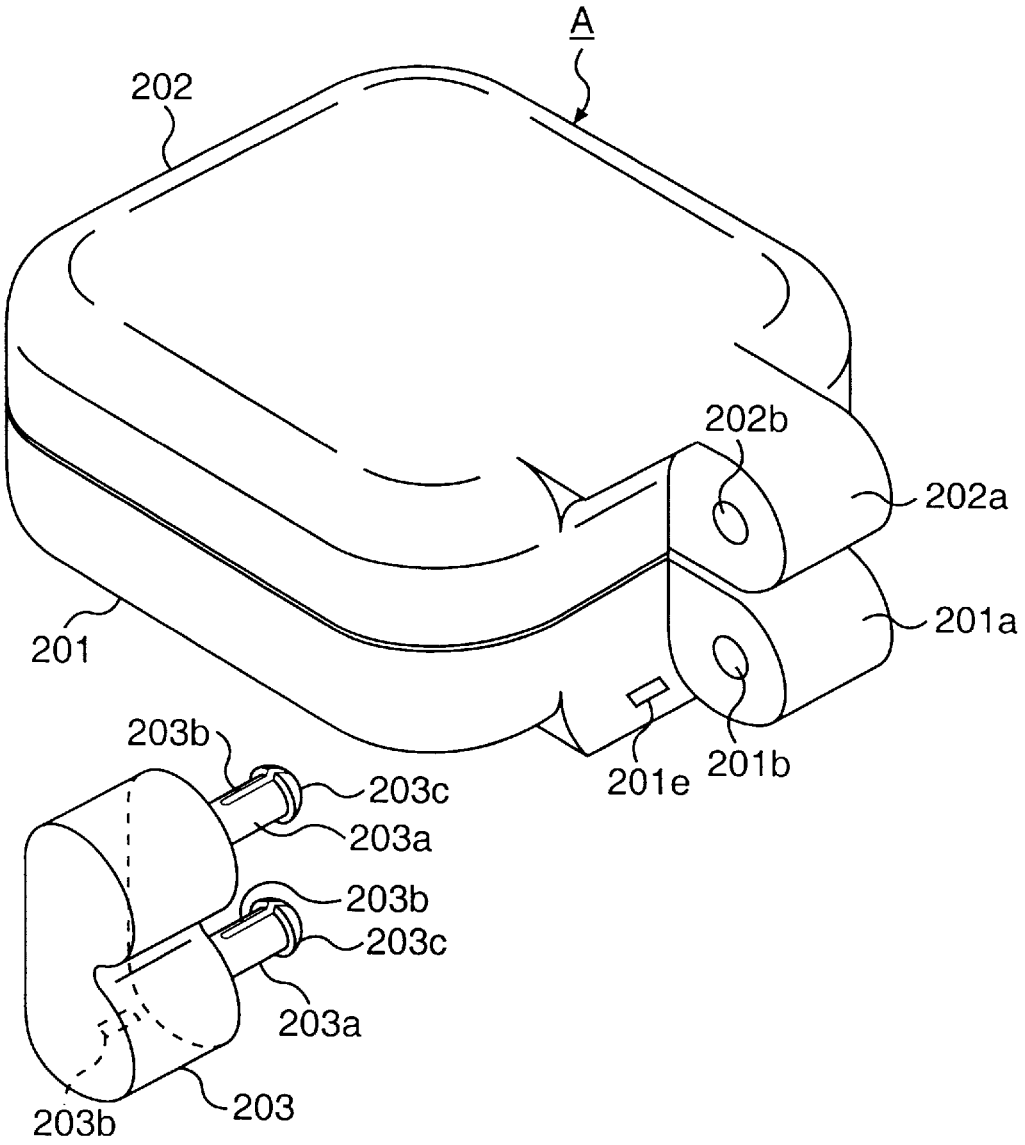
FIG. 9 is an exploded perspective view showing a compact cosmetic case according to the second embodiment.
Figure 10:
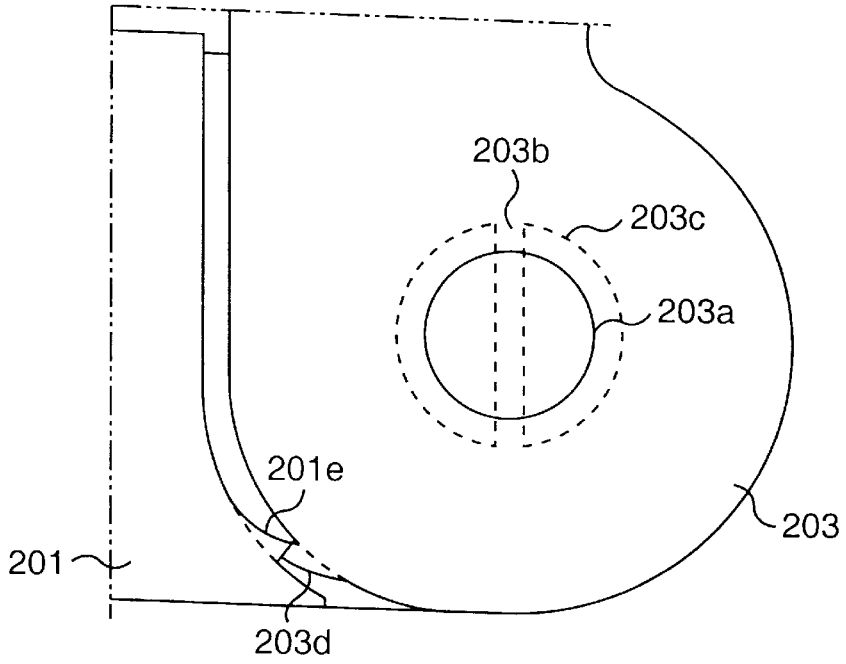
FIG. 10 is an enlarged cross section showing a hinge member.
Figure 11:
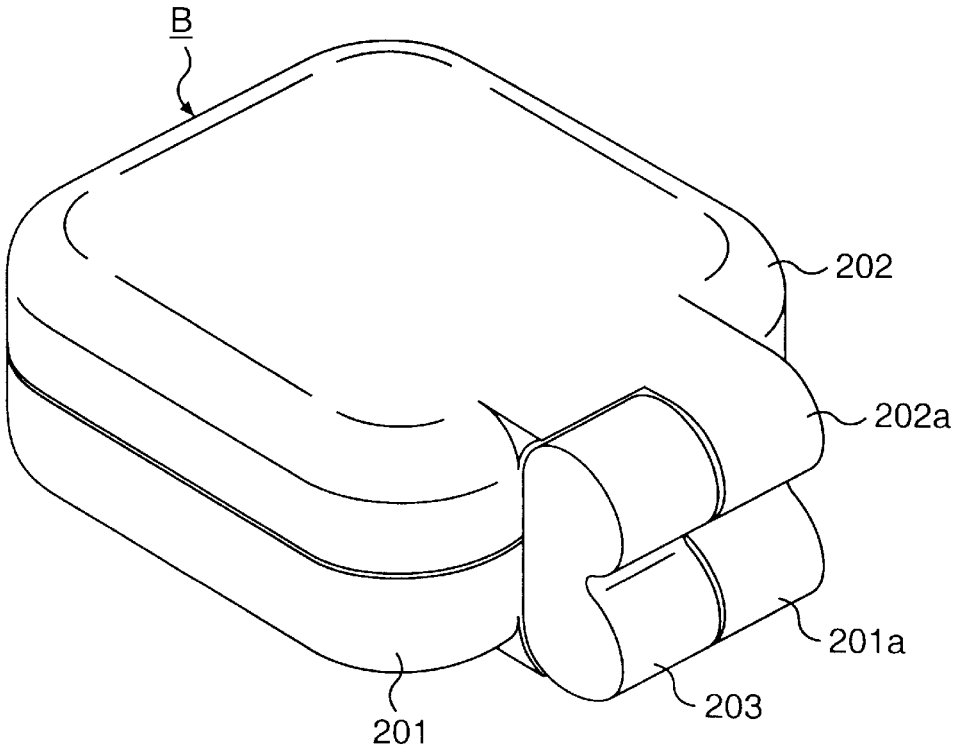
FIG. 11 is a perspective view showing the whole compact cosmetic case.
Figure 12:
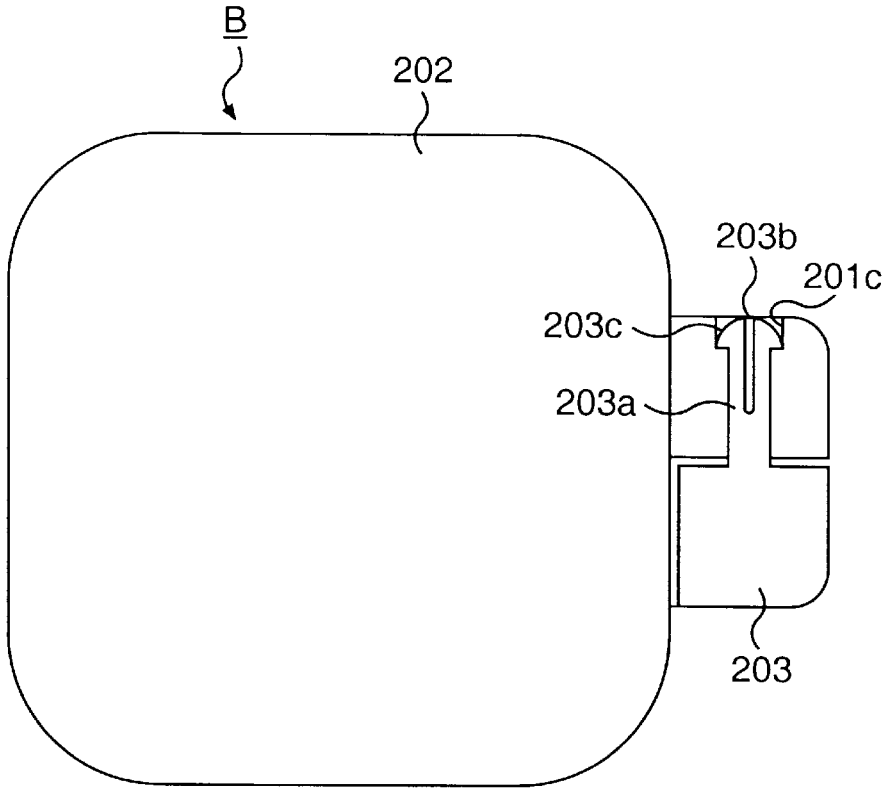
FIG. 12 is a horizontal cross section showing the compact cosmetic case.
Figure 13:
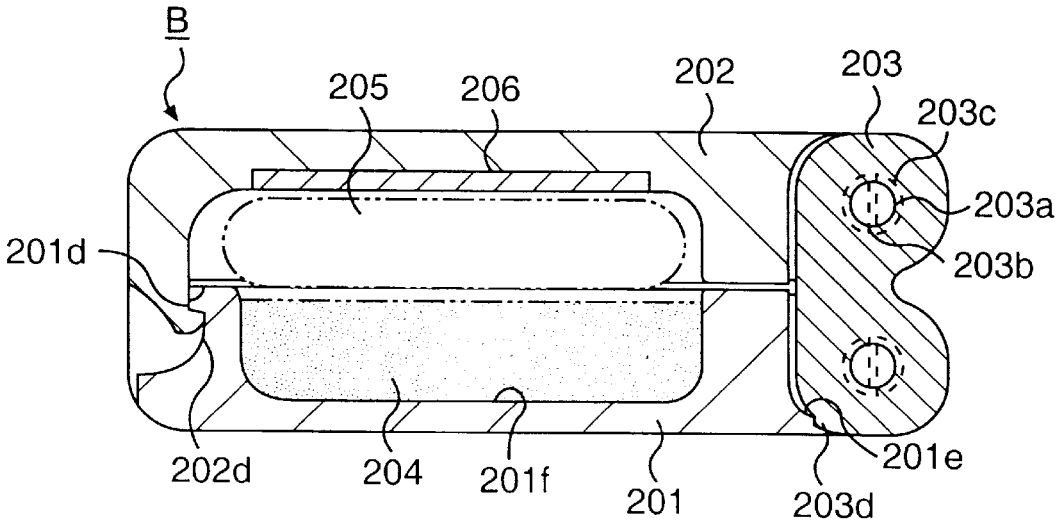
FIG. 13 is a side cross section showing the compact cosmetic case in a state that the lid is closed.

Referring to the drawings, the second embodiment of a compact cosmetic case capable of displaying the inside of the case according to the invention is described. FIG. 9 is an exploded perspective view showing a compact cosmetic case according to this embodiment; FIG. 10 is an enlarged cross section showing a hinge portion of the compact cosmetic case; FIG. 11 is a perspective view showing the whole compact cosmetic case; FIG. 12 is a top view showing the compact cosmetic case; FIG. 13 is a side cross section showing the compact cosmetic case.

The compact cosmetic case B is mainly constituted of a housing 201, a lid 202, and a hinge member 203, which are made of a synthetic resin. Extended portions 201*a*, 202*a* are formed at respective edges of the housing 201 and the lid 202. The extended portions 201*a*, 202*a* are formed as shown in FIG. 9 in a shape cutting off one edge of the housing 201 and the lid 202, and the edge can be completed by attaching the hinge member 203 as described below. The extended portions 201*a*, 202*a* have fitting holes 201*b*, 202*b*. The fitting holes 201*b*, 202*b* have a stepwise inner diameter as shown in FIG. 12, and has a larger diameter portion 201*c* on the side opposite to the side to which the hinge member 203 is attached.

An engagement tongue 201*d* is arranged on one side of the housing 201 opposite to the extended portion 201*a*, and on the other hand, in corresponding to this, another engagement tongue 202*d* is arranged on one side of the lid 202 opposite to the extended portion 202*a*. The engagement tongues 201*d*, 202*d* engage with each other as shown in FIG. 13 when the housing 201 and the lid 202 are closed and can immobilize the housing 201 and the lid 202.

The hinge member 203 is formed with two parallel extending axial member 203*a* as a united body. A slit 203*b* is formed on each tip of the two axial member 203*a* to produce the elasticity, and an engagement portion 203*c* having a larger outer diameter is formed on the tip of the axial member 203*a*.

The outer surface of the hinge member 203 is in a shape having a pair of mountains in the cross section as to continue with the outer surfaces of the extended portions 201*a*, 202*a* of the housing 201 and the lid 202, and when the hinge member 203 is mounted on the housing 201 and the lid 202, those are viewed as a united body. Particularly, where the hinge member 203 is made as a separate part, the color of the outside can be different from those of the housing 201 or the lid 202 to create an one point design, or can be utilized as a mark for indicating color or kind of the contained cosmetic material K.

When the hinge member 203 is attached to the housing 201 and the lid 202, the tip of the axial member 203*a* is bent in aid of the slit 203*b*, so that the engagement portion 203*c* can be inserted in the fitting holes 201*b*, 202*b*. When the inserted engagement portion 203*c* of the axial member 203*a* reaches the larger diameter portion 201*c*, the tip of the axial member 203*a* become wider by its elasticity, and the engagement portion 203*c* is engaged with the larger diameter portion 201*c* as shown in FIG. 12. That is, the housing 201, the lid 202, and the hinge member 203 can be coupled with each other only by insertion of the axial members 203*a* into the fitting holes 201*b*, 202*b*, so that the compact cosmetic case can be assembled very easily, as well as assembling work can be simplified.

In the compact cosmetic case B thus assembled, since the compact cosmetic case B has a structure that the housing 201 and the lid 202 can rotate respectively around the axial member 203*a* as a center, the housing 201 and the lid 202 can rotate independently without interfering with each other, and the lid 202 can be rotated almost 360 degrees with respect to the housing 201 as described below.

As shown in FIGS. 9, 10, the engagement projections 201*e*, 203*d* are formed at the hinge member 203 and the housing 201 at positions facing to each other where the housing 201 and the lid 202 are in the closed state. The engagement projections 201*e*, 203*d* restrict relative rotation in contact with each other, but when rotation force of a predetermined amount is exerted, such restriction is released and rotatable.

With the axial member 203*a* inserted in the fitting holes 201*b*, 202*b* as described above, the tip of the axial member 203*a* is frictionally engaged with an inner round surface of the fitting holes 201*b*, 202*b* by the elasticity of the slit 203*b*, so that when the lid 202 is rotated, the lid 202 can be stopped freely with any angle with respect to the housing 201.

As shown in FIG. 13, a containing recess 201*f* is formed with an large opening for filling a cosmetic material 204 at a center of the housing 201, and when the compact cosmetic case B is used, a cosmetic puff can be mounted on the cosmetic material 204. A mirror 206 is attached to an inner surface of the lid 202 and serves when the lid 202 is open.

Figure 14:
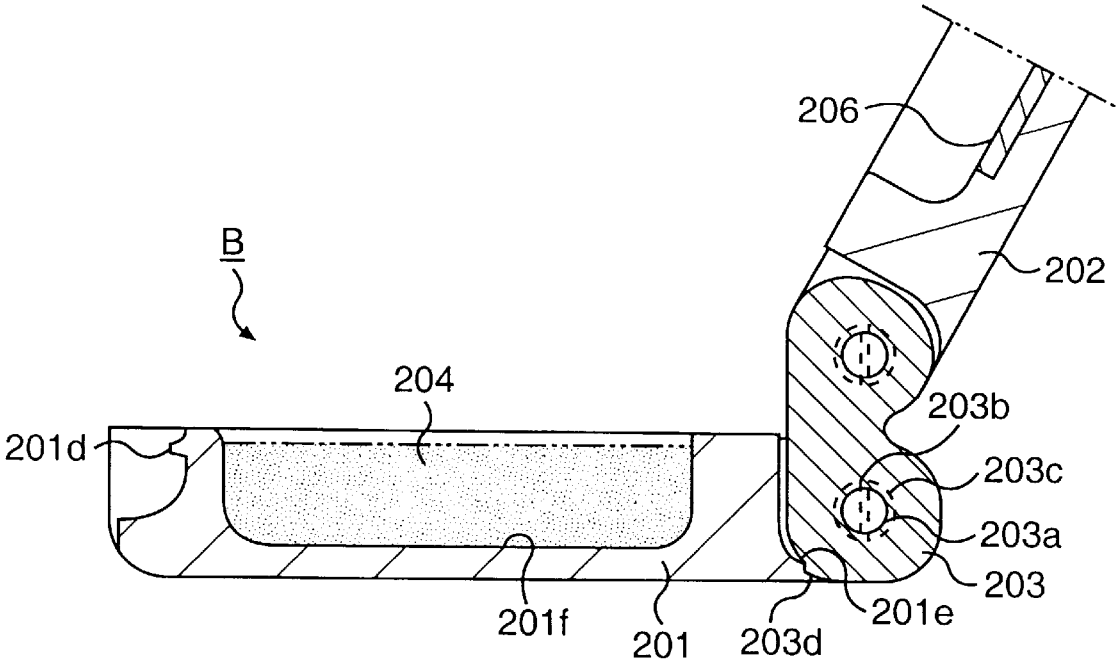
FIG. 14 is a side cross section showing the compact cosmetic case in a state that the lid is open.
Figure 15:
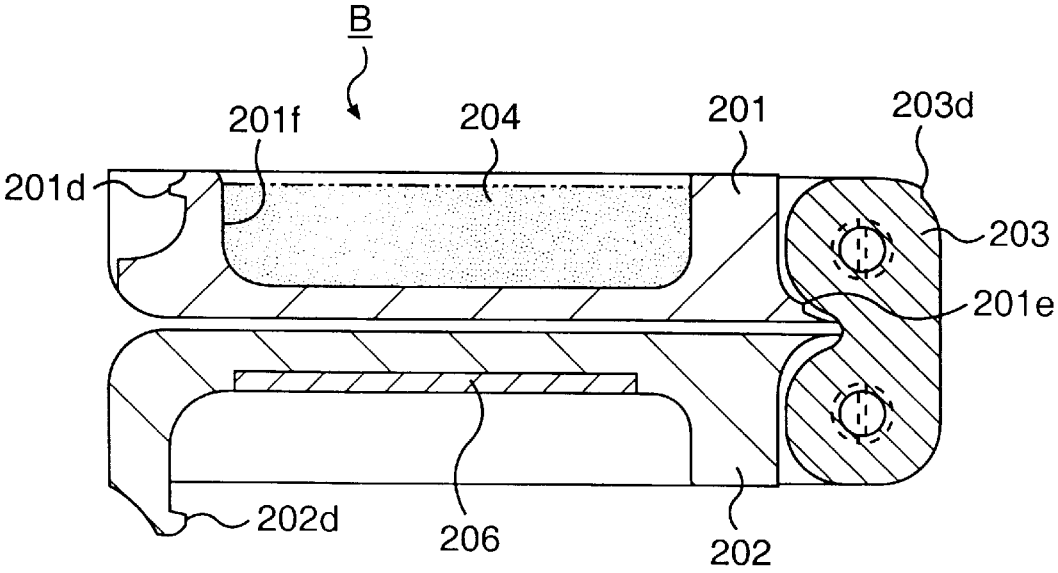
FIG. 15 is a side cross section showing the compact cosmetic case in a state that the lid is perfectly open.
Figure 16:
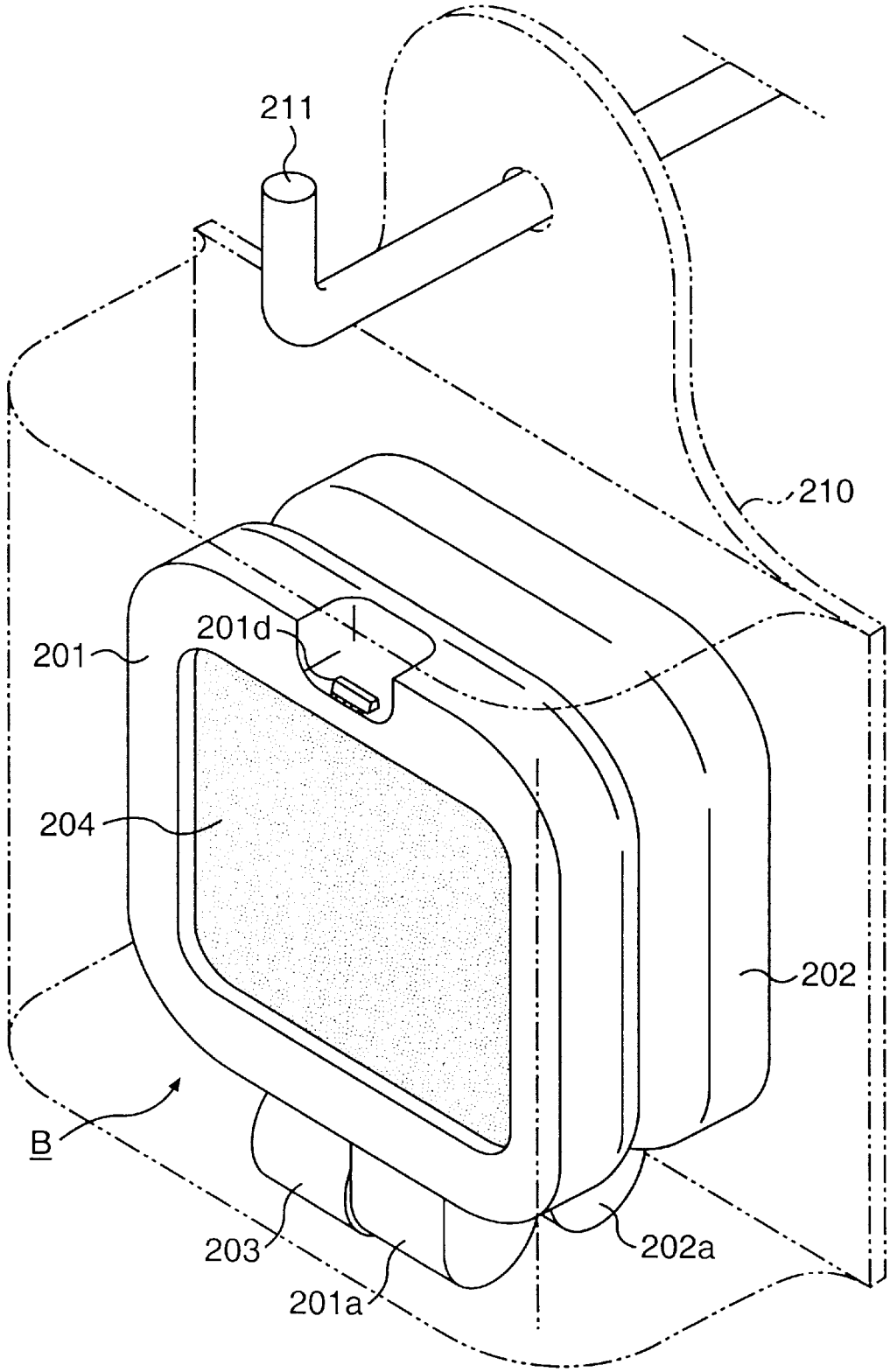
FIG. 16 is an illustration showing a display state of the compact cosmetic case.

The compact cosmetic case B according to this embodiment operates as follows. FIG. 14 is a view showing the compact cosmetic case in a state that the lid is open with 360 degrees; FIG. 15 is a view showing the operation of the compact cosmetic case; FIG. 16 is a view showing the compact cosmetic case in a display state.

First, when the compact cosmetic case B is assembled, as shown in FIG. 15, the housing 201 and the lid 202 are overlapped so that the outer surfaces are facing to each other, and the axial members 203*a*, 203*a* of the hinge member 203 are inserted in the fitting holes 201*b*, 202*b* while the extended portions 201*a*, 202*a* of the housing 201 and the lid 202 are arranged in line. As described above, the engagement portions 203*c* at the tip of the axial members 203*a* are engaged respectively with the larger diameter portions 201*c*, 202*c* of the fitting holes 201*b*, 202*b*, thereby rotatively coupling the housing 201 and the lid 202 with each other.

The compact cosmetic case B thus in a display state, or namely, in a state that the cosmetic material 204 is exposed, is contained in a display package 210 as shown in FIG. 16, and placed in the store as the compact cosmetic case B within the display package 210 is hung from a hook 211. The display package 210 is a package, like a so-called Brister package, whose front side is covered with at least transparent film where a product is placed on a card board paper, and customers can confirm the surface of the cosmetic material 204 where the compact cosmetic case B is contained so that the housing 201 of the compact cosmetic case B faces forward. Therefore, the compact cosmetic case can provide adequate information to the customers for product selection regarding color and brightness of the cosmetic material 204.

Although a compact cosmetic case of a conventional structure can be displayed in a state that the lid is opened with an angle of 180 degrees, the compact cosmetic case B in this embodiment can render the lid 202 rotate further about 360 degrees, thereby making the lid 202 and the housing 201 displayed in an overlapped state. Therefore, the front area size when the compact cosmetic case is displayed can be made smaller, and a larger number of products can be displayed in a limited display space.

A customer who purchased the compact cosmetic case B starts using the compact cosmetic case B by closing the lid as to fit to the housing as shown in FIG. 13. The engagement projections 201*e*, 203*d* come over one another first time when the lid is closed and thereafter restrict the rotation of the housing 201 and the hinge member 203 when the lid 202 is open. Accordingly, when the lid is made open for ordinary use, the lid 202 only is rotated in substantially the same manner as a conventional cosmetic case as shown in FIG. 14, so that a user can use the cosmetic material 204 and the mirror 206.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but defined claims set forth below.

What is claimed is:

1. A cosmetic case capable of displaying the inside of the case, comprising:

a housing for containing a cosmetic material, the housing having an opening for exposing the surface of the cosmetic material;

a lid for closing the opening formed at the housing; and a hinge member attached to each edge of the housing and the lid to rotatably connect the housing and the lid with each other so that respective outer surfaces of the housing and the lid come to face closely to each other, the hinge member comprising:

a pair of shafts members; and a pair of support members, each support member arranged on each end of the pair of the shaft members, wherein each of the housing and the lid has a coupling portion having a fitting groove for fitting one of the shaft members to hide the shaft members and to expose the support members on opposite sides of the coupling portion.

2. The cosmetic case according to claim 1, wherein the hinge member has a flat face portion, which is placed closely on a side of the housing and hidden where the housing and the lid are in a closed state, and which serves as a bottom surface for supporting the whole case by coming to a position on the opposite side to the housing where the housing and the lid are so rotated that respective outer surfaces of the housing and the lid come to face closely to each other.

3. A cosmetic case capable of displaying the inside of the case, comprising:

a housing for containing a cosmetic material, the housing having an opening for exposing the surface of the cosmetic material and an extended portion in which a fitting hole is formed;

a lid for closing the opening formed at the housing, the lid having an extended portion in which a fitting hole is formed; and a hinge member attached to each edge of the housing and the lid to rotatably connect the housing and the lid with each other so that respective outer surfaces of the housing and the lid come to face closely to each other, the hinge member having a pair of axial members extending parallel to each other formed on the hinge member, each axial member having a diameter substantially equal to a diameter of the fitting holes, elasticity in the diameter direction, and an engagement portion made on a tip of the axial member radially larger than the diameter of the axial member.

* * * * *